US005867581A

United States Patent [19]

Obara

[11] Patent Number: 5,867,581

[45] Date of Patent: Feb. 2, 1999

[54] HEARING AID

[75] Inventor: Kazuaki Obara, Neyagawa, Japan

[73] Assignee: Matsushita Electric Industrial Co., Ltd., Osaka, Japan

[21] Appl. No.: 540,872

[22] Filed: Oct. 11, 1995

[30] Foreign Application Priority Data

Oct. 14, 1994 [JP] Japan ..... 6-249665
Feb. 23, 1995 [JP] Japan ..... 7-034877

[51] Int. Cl.[6] ..... H04R 25/00

[52] U.S. Cl. ..... 381/312; 381/320

[58] Field of Search ..... 381/68, 68.2, 68.4, 381/56, 57, 94, 104, 107, 109, 110, 92, 94.2, 312, 313, 320, 321, 122

[56] References Cited

U.S. PATENT DOCUMENTS

| | | | |
|---|---|---|---|
| 3,920,931 | 11/1975 | Yanick, Jr. . | |
| 4,025,721 | 5/1977 | Graupe et al. . | |
| 4,461,025 | 7/1984 | Franklin . | |
| 4,630,304 | 12/1986 | Borth et al. . | |
| 4,759,071 | 7/1988 | Heide | 381/68.4 |
| 4,790,018 | 12/1988 | Preves et al. . | |
| 4,926,484 | 5/1990 | Nakano | 381/110 |
| 4,996,712 | 2/1991 | Laurence . | |
| 5,083,312 | 1/1992 | Newton et al. . | |
| 5,091,952 | 2/1992 | Williamson et al. . | |
| 5,131,046 | 7/1992 | Killion et al. | 381/68.2 |
| 5,165,017 | 11/1992 | Eddington et al. . | |
| 5,201,006 | 4/1993 | Weinrich . | |
| 5,318,502 | 6/1994 | Gilman . | |
| 5,402,496 | 3/1995 | Soli et al. . | |
| 5,524,056 | 6/1996 | Killion et al. | 381/312 |

FOREIGN PATENT DOCUMENTS

| | | |
|---|---|---|
| 5-56499 | 3/1993 | Japan . |
| 5-64297 | 3/1993 | Japan . |
| 5-72025 | 3/1993 | Japan . |
| 5-76497 | 3/1993 | Japan . |
| 5-284587 | 10/1993 | Japan . |
| 6-98398 | 4/1994 | Japan . |
| 6-189395 | 7/1994 | Japan . |
| 6-195097 | 7/1994 | Japan . |
| 6-276599 | 9/1994 | Japan . |

OTHER PUBLICATIONS

European Search Report corresponding to Appl. No. EP 95 11 6192 dated Feb. 26, 1998.

Bishnu S. Atal et al., "A Pattern Recognition Approach to Voiced–Unvoiced–Silence Classification with Applications to Speech Recognition", *IEEE Transactions on Acoustics, Speech, and Signal Processing*, vol. ASSP–24, No. 3, Jun. 1976.

*Primary Examiner*—Huyen Le
*Attorney, Agent, or Firm*—Ratner & Prestia

[57] ABSTRACT

According to a hearing aid comprising a voiceless period information detecting means for detecting information about a voiceless period based on sound received by a sound input means, and a control means for changing an amplification factor of an amplifying means or switching on/off output of sound emitted by a sound output means based on the sound received by the sound input means and the information about the voiceless period, output of the hearing aid can be controlled depending on noise included in the sound.

Moreover, according to a hearing aid comprising a specific sound detecting means for detecting sound having specific frequency from sound received by a sound input means, and control means for changing an amplification factor of an amplifying means or switching on/off output of sound emitted by a sound output means, or making the sound output means receive either a signal passing through a filter for the specific frequency or a signal bypassing the filter, based on the sound having the specific frequency, warning sound having the specific frequency or the like appearing suddenly in ambient sound can be attenuated.

2 Claims, 7 Drawing Sheets

HEARING AID

BACKGROUND OF THE INVENTION

1. Field of the Invention

The present invention relates to a hearing aid for controlling the emitted sound in consideration of the ambient sound.

The invention also relates to a hearing aid for controlling the emitted sound depending on the information presented by the wearer of the hearing aid.

2. Related Art of the Invention

A conventional hearing aid amplified the received sound, without distinguishing voice from other sound than voice, and emitted the amplified sound to the wearer of the hearing aid, and therefore when the ambient sound other than the voice became loud, a discomfort was given to the wearer of the hearing aid.

A conventional hearing aid, similarly, amplified the alarm sound released by an ambulance or the like, the warning sound at the crossing, or other ambient sound, together with the voice, the power level of the output sound was excessive, and it gave an extreme discomfort to the wearer of the hearing aid.

SUMMARY OF THE INVENTION

It is an object of the invention to provide a hearing aid capable of controlling the volume of output sound or its switching, on the basis of a voiceless period extracted from the input sound.

It is another object of the invention to provide a hearing aid capable of controlling volume of output sound or its switching, or attenuating a frequency band of warning sound included in the output sound, by detecting the warning sound, for example, when the warning sound suddenly gets into ambient sound included in input sound.

It is a further object of the invention to provide a hearing aid capable of controlling volume of output sound or its switching, for example, by extracting a specific action by a wearer of the hearing aid.

To achieve the above objects, the invention provides a hearing aid comprising: a sound input means for receiving sound, an amplifying means for amplifying the sound received by the sound input means, a sound output means for emitting the sound amplified by the amplifying means, a voiceless period information detecting means for detecting information about at least one voiceless period, on the basis of the sound received by the sound input means, and a control means for changing an amplification factor of the amplifying means or for switching on/off output of the sound emitted by the sound output means, on the basis of the information and the sound received by the sound input means, or on the basis of the information.

Also, to achieve the above objects, the invention provides a hearing aid comprising: a sound input means for receiving sound, an amplifying means for amplifying the sound received by the sound input means, a sound output means for emitting the sound amplified by the amplifying means, a specific sound detecting means for detecting sound having specific frequency from the sound received by the sound input means, and a control means for changing an amplification factor of the amplifying means, or for switching on/off output of the sound emitted by the sound output means, on the basis of the sound having the specific frequency.

Further, to achieve the above objects, the invention provides a hearing aid comprising: a sound input means for receiving sound, an amplifying means for amplifying the sound received by the sound input means, a sound output means for emitting the sound amplified by the amplifying means, a specific sound detecting means for detecting sound having specific frequency from the sound received by the sound input means, and a control means for managing whether or not to connect a filter which damps the sound having specific frequency either between the sound input means and the amplifying means, or between the amplifying means and the sound output means.

Furthermore, to achieve the above objects, the invention provides a hearing aid comprising: a sound input means for receiving sound, an amplifying means for amplifying the sound received by the sound input means, a sound output means for emitting the sound amplified by the amplifying means, an information detecting means for detecting specific information presented by a wearer of the hearing aid, and a control means for changing an amplification factor of the amplifying means or for switching on/off output of the sound emitted by the sound output means on the basis of the specific information.

BRIEF DESCRIPTION OF THE DRAWINGS

These and other objects, advantages, features, and uses will become more apparent as the description proceeds, when considered with the accompanying drawings in which:

FIG. 4(*b*) is another diagram showing an example frequency and time structure of warning sound;

DETAILED DESCRIPTION

Figure 1:
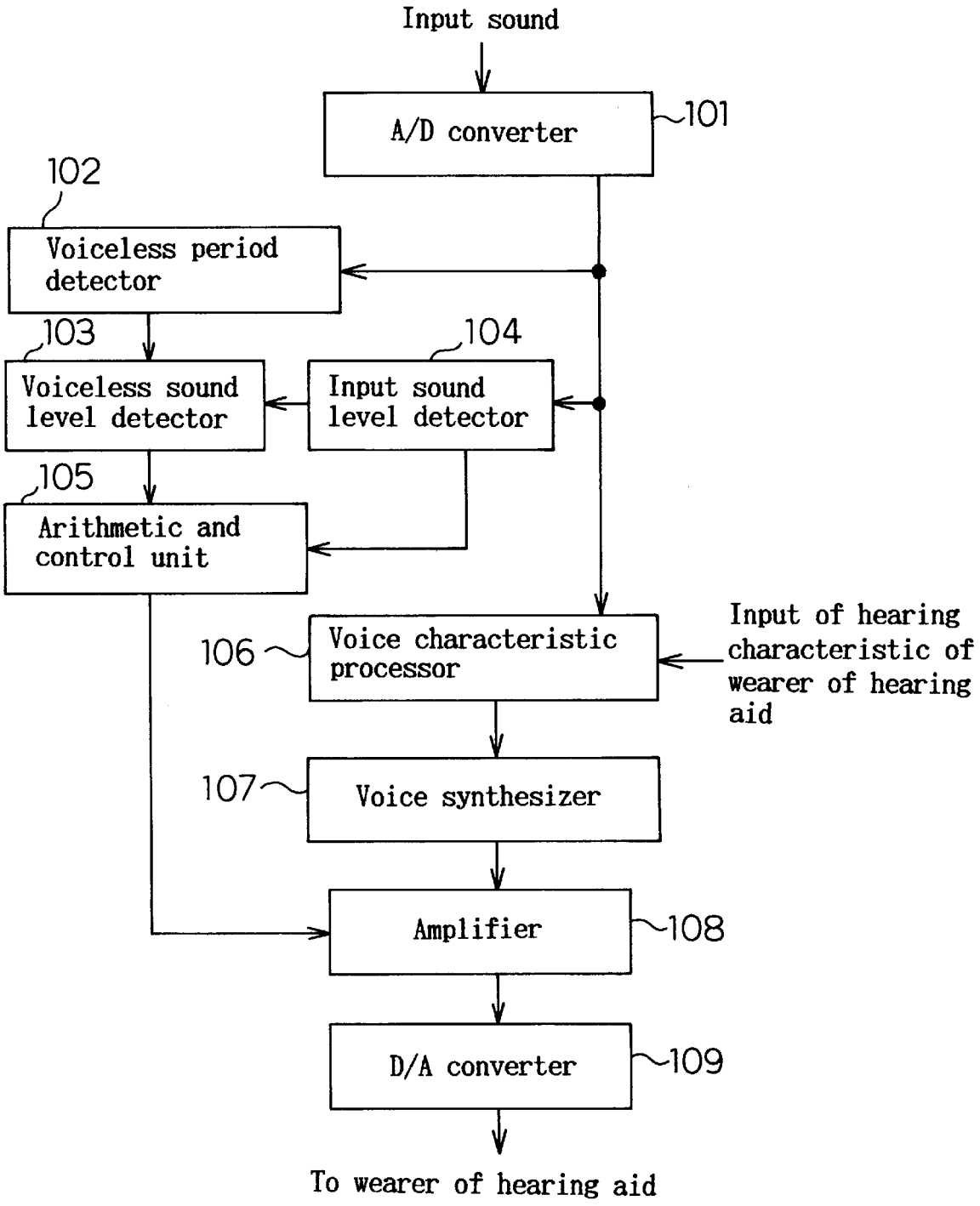
FIG. 1 is a structural diagram of a first embodiment of a hearing aid of the invention.

Referring now to FIG. 1, there is shown therein a structural diagram of a first embodiment of a hearing aid of the invention. Herein, reference numeral 101 is an A/D converter for converting input sound from analog to digital signal. Reference numeral 102 is a voiceless period detector for detecting a voiceless period from the A/D converted input sound. Reference numeral 103 is a voiceless level detector for measuring a power level of sound in the voiceless period detected by the voiceless period detector 102. Reference numeral 104 is an input sound level detector for measuring a power level of the A/D converted input sound. Reference numeral 105 is an arithmetic and control unit for calculating a ratio of the power level measured by the input sound level detector 104 to the power level measured by the voiceless level detector 103.

Reference numeral 106 is a voice characteristic processor for changing characteristic of frequency and time of the A/D converted input sound, depending on hearing characteristic of a wearer of the hearing aid of the embodiment. In the voice characteristic processor 106, the hearing characteristic of the wearer is stored in advance. Reference numeral 107 is a voice synthesizer for synthesizing synthetic sound on the basis of the A/D converted input sound having the characteristic changed by the voice characteristic processor 106.

Reference numeral 108 is an amplifier for amplifying a power level of the synthetic sound synthesized by the voice synthesizer 107, on the basis of the ratio calculated by the arithmetic and control unit 105. Reference numeral 109 is a D/A converter for converting the synthetic sound of which power level is amplified by the amplifier 108 from digital into analog signal in order to emit output sound to the wearer.

The operation of the first embodiment will now be explained. The A/D converter 101 converts input sound from analog to digital signal, and sends it to the voice characteristic processor 106. The voice characteristic processor 106 suppresses ambient noise contained in a voice period by a known method called spectrum subtraction method, and changes characteristic of frequency and time of the A/D converted input sound depending on hearing characteristic of the wearer. The voice synthesizer 107 receives a signal processed by the voice characteristic processor 106, and synthesizes synthetic sound by a known method of DFT (discrete Fourier transform) or LPC (liner predictive coding).

The input sound converted by the A/D converter 101 is put into a voiceless period detector 102. The voiceless period detector 102 detects a voiceless period by a known method of short-time average zero-crossing rate technique.

The short-time average zero-crossing rate is a method of comparing consecutive sample pairs of the input sound converted by the A/D converter 101, judging whether code change (zero crossing) is present or not, and accumulating the zero crossing at set time intervals. The short-time average zero-crossing rate when voice is included in the input sound is higher than that in the voiceless period not containing voice in the input sound. In the embodiment, accordingly, when the short-time average zero-crossing rate in the analysis section is smaller than the threshold value (for example, the value is preset to make zero crossing of a voice period become five times greater than that of a voiceless period.) which is preset depending on the short-time average zero-crossing rate in the voice period, the voiceless period detector 102 judges that the analysis section is a voiceless period.

The arithmetic and control unit 105 determines a ratio (F1/Fenv) from the power level measured by the input sound level detector 104 and the power level measured by the voiceless level detector 103.

When the ratio is smaller than a predetermined value (for example, 20 dB), it is judged that the relative noise level is high, and hence gain of the amplifier 108 is lowered. As a result, the output level of the sound to the wearer is lowered, and the unpleasant sound including noise of high level is not applied to the wearer. On the other hand, when the ratio is greater than the predetermined value, it is judged that the relative noise level is low, so that the gain of the amplifier 108 is set to an ordinary value. The D/A converter 109 D/A converts the signal thus set in gain and amplified.

According to the embodiment, therefore, by lowering the gain of the amplifier 108 when the relative noise level is high on the basis of the ratio of the power level of the input sound and the power level of the sound in the voiceless period, the unpleasant sound due to excessively amplified noise is prevented from being applied to the wearer.

Also in the embodiment, on the basis of the voiceless period detected by employing the short-time average zero-crossing rate, the relative noise level contained in the output sound is judged, but not limited to this, the relative noise level contained in the output sound may be judged on the basis of a ratio of a power level of low range frequency to power level of high range frequency, in the input sound, or the information of profile of frequency spectrum of analyzed sound.

Further in the embodiment, A/D converter 101 includes a low pass filter before the input of A/D converter. D/A converter 109 includes a low pass filter after the output of D/A converter.

Figure 2:
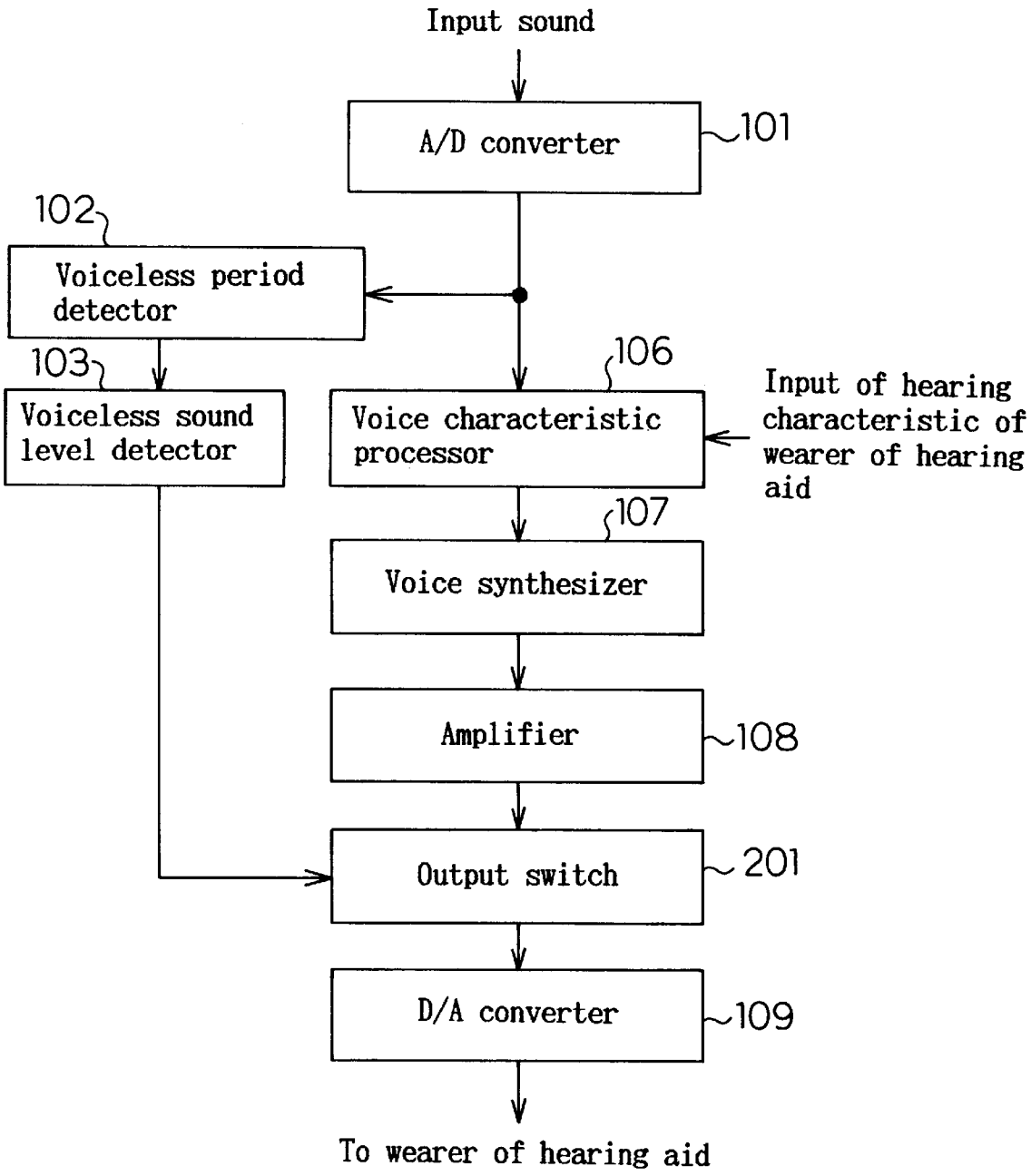
FIG. 2 is a structural diagram of a second embodiment of a hearing aid of the invention.

Referring to FIG. 2, there is shown therein a structural diagram of a second embodiment of a hearing aid of the invention. Herein, reference numeral 101 is an A/D converter for converting input sound from analog to digital signal. Reference numeral 102 is a voiceless period detector for detecting a voiceless period from the A/D converted input sound. Reference numeral 103 is a voiceless level detector for measuring a power level of sound in the voiceless period detected by the voiceless period detector 102.

Reference numeral 106 is a voice characteristic processor for changing characteristic of frequency and time of the A/D converted input sound, depending on hearing characteristic of a wearer of the hearing aid of the embodiment. In the voice characteristic processor 106, the hearing characteristic of the wearer is stored in advance. Reference numeral 107 is a voice synthesizer for synthesizing synthetic sound on the basis of the A/D converted input sound having the characteristic changed by the voice characteristic processor 106. Reference numeral 108 is an amplifier for amplifying a power level of the synthetic sound synthesized by the voice synthesizer 107.

Reference numeral 201 is an output switch for turning on/off the synthetic sound of which power level is amplified by the amplifier 108, on the basis of a power level of sound in the voiceless period detected by the voiceless level detector 103. Reference numeral 109 is a D/A converter for converting the amplified signal sent when the output switch 201 is ON from digital to analog signal, in order to generate output sound to the wearer.

The operation of the second embodiment will be now explained. The A/D converter 101 converts input sound from analog to digital signal, and sends it to the voice characteristic processor 106. The voice characteristic processor 106 suppresses ambient noise contained in a voice period by a known method called spectrum subtraction method, and changes characteristic of frequency and time of the A/D converted input sound depending on hearing characteristic of the wearer. The voice synthesizer 107 receives a signal processed by the voice characteristic processor 106, and synthesizes synthetic sound by a known method of DFT (discrete Fourier transform) or LPC (liner predictive coding). The amplifier 108 amplifies a power level of the synthetic sound synthesized by the voice synthesizer 107.

The input sound converted by the A/D converter 101 is put into a voiceless period detector 102. The voiceless period detector 102 detects a voiceless period by the known method of the short-time average zero-crossing rate technique, same as in the first embodiment. The voiceless level detector 103 measures a power level of sound in the voiceless period.

When the power level of the sound in the voiceless period is greater than a preset value (for example, 20 dB), it is judged that noise is high, and the output switch 201 is set in OFF state. As a result, unpleasant sound containing much noise is prevented from being applied to the wearer. On the other hand, when the power level of the sound in the voiceless period is smaller than the preset value, it is judged that the noise is low, and the output switch 201 is set in ON state. The D/A converter 109 D/A converts the synthetic sound of which power level is amplified by the amplifier 108 when the output switch 201 is ON, In this way, when much noise is contained in the ambient sound on the basis of the power level of the sound in the voiceless period, the output switch 201 is set in OFF state, so that the unpleasant sound due to excessively amplified noise is prevented from being applied to the wearer.

Figure 3:
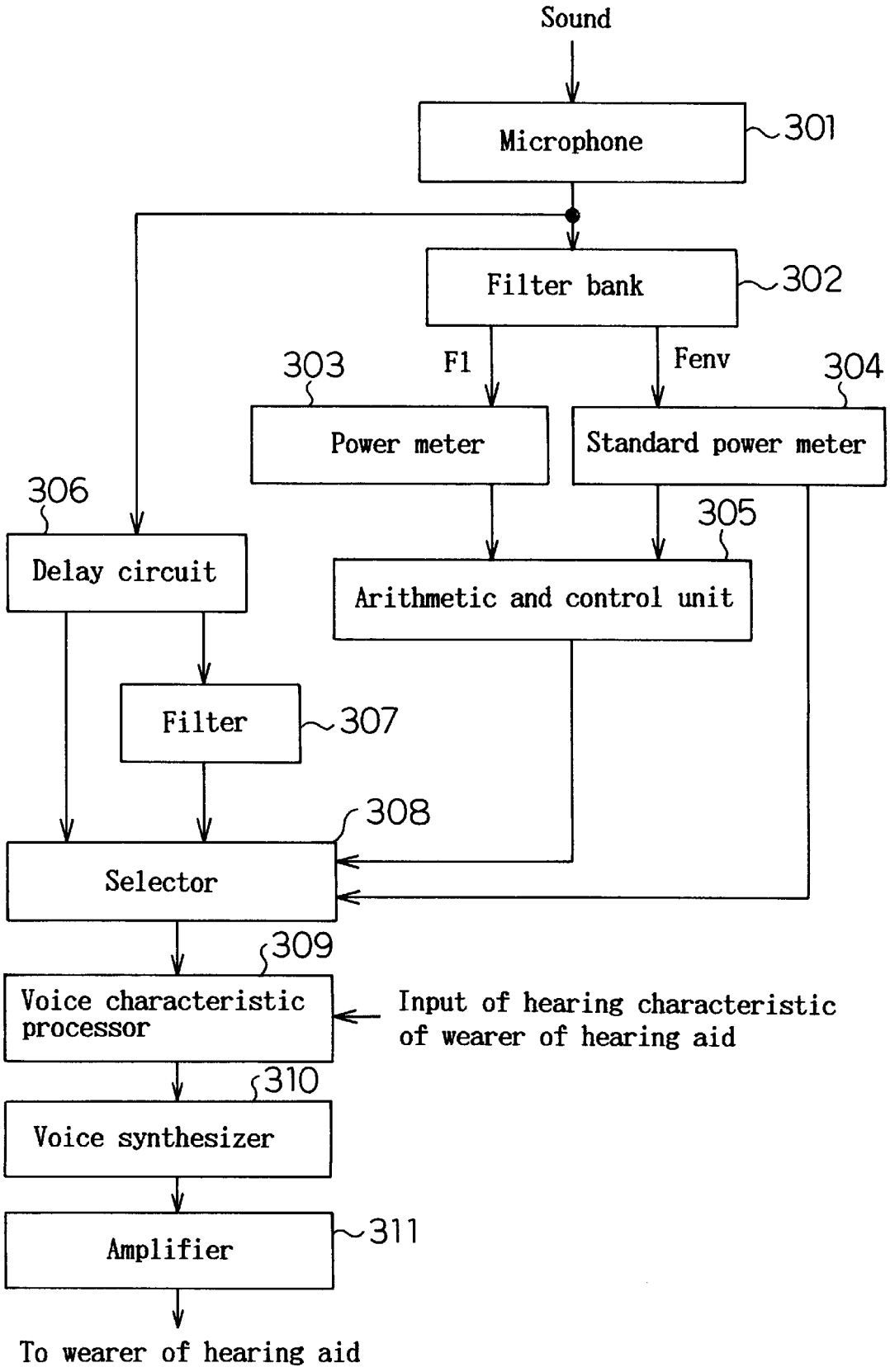
FIG. 3 is a structural diagram of a third embodiment of a hearing aid of the invention.
Figure 4:
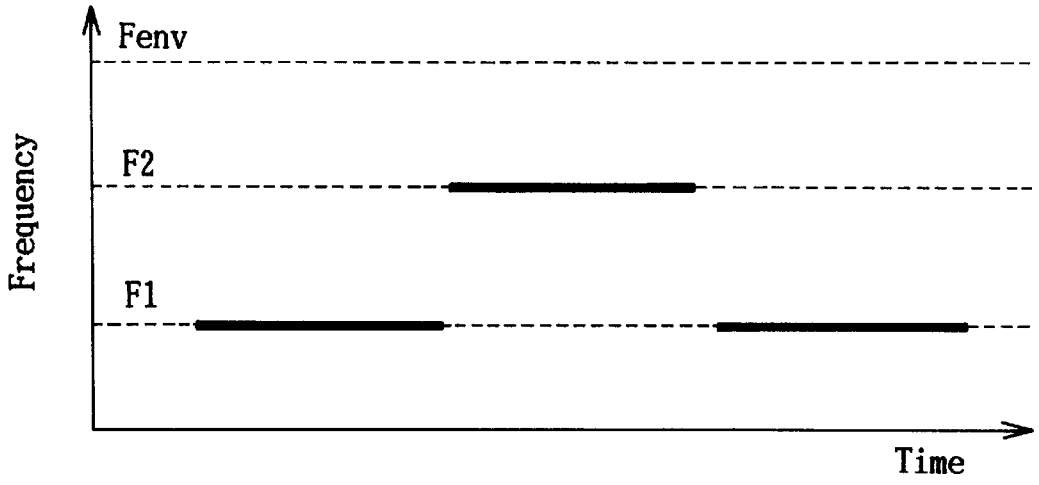
FIG. 4(*a*) is a diagram showing an example frequency and time structure of warning sound.
Figure 4:
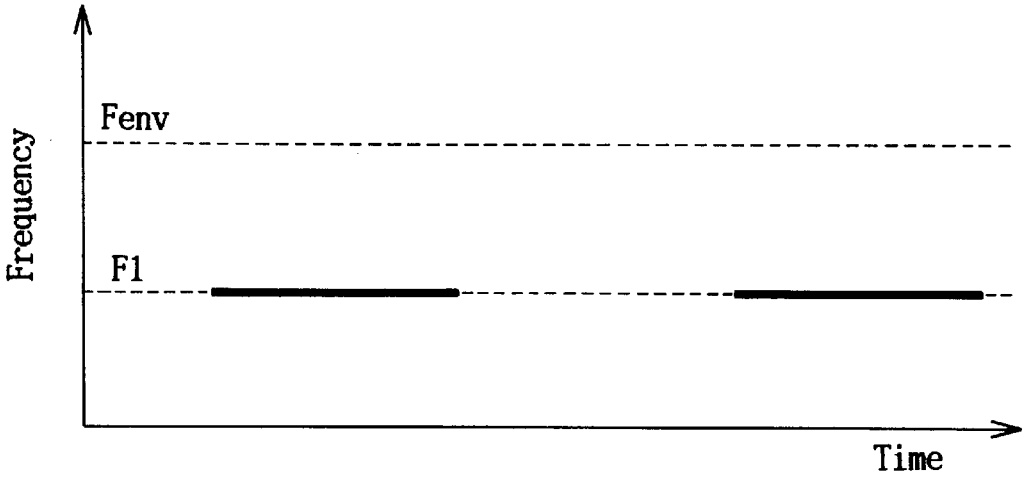

Referring to FIG. 3, there is shown therein a structural diagram of a third embodiment of a hearing aid of the invention. The hearing aid of this embodiment is effective when warning sound suddenly gets into ambient sound contained in input sound. General warning sound includes the siren of the ambulance, fire engine or police car, and the sign sound for pedestrians at the crossing. These alarms are the sound having a extremely strong power as compared with the level of usual ambient sound at a specific frequency, and possess a specific time-frequency structure. The warning sound in the embodiment is assumed to be sound at frequency F1 [Hz] or having a band width around the frequency F1, as shown in FIG. 4(*b*).

Reference numeral 301 is a microphone for picking up sound. Reference numeral 302 is a filter bank for analyzing frequency of the sound picked up by the microphone 301. Reference numeral 303 is a power meter for measuring a power level of the frequency F1 analyzed by the filter bank 302. Reference numeral 304 is a standard power meter for detecting a specific frequency Fenv [Hz] which is not contained in the warning sound having the frequency F1 and for measuring a power level of the frequency Fenv in the period. Reference numeral 305 is an arithmetic and control unit for determining a ratio (F1/Fenv) of the power level of the frequency F1 measured by the power meter 303 to the power level of the frequency Fenv measured by the standard power meter 304.

Reference numeral 306 is a delay circuit for delaying the sound picked up by the microphone 301. This is to compensate for processing time by the filter bank 302, the power meter 303, the standard power meter 304, and the arithmetic and control unit 305. Reference numeral 307 is a filter corresponding to the frequency F1 in order to remove the warning sound having the frequency F1. Reference numeral 308 is a selector for selecting whether to receive the sound delayed by the delay circuit 306 to send out into the voice characteristic processor 309 or to receive a signal through the filter 307 to send out to the voice characteristic processor 309 nor to receive either signal to send out, on the basis of the ratio determined by the arithmetic and control unit 305 and the power level of the frequency Fenv measured by the standard power meter 304.

Reference numeral 309 denotes a voice characteristic processor for changing characteristic of frequency and time of the signal sent from the selector 308, depending on hearing characteristic of a wearer. In the voice characteristic processor 309, the hearing characteristic of the wearer is stored in advance. Reference numeral 310 is a voice synthesizer for synthesizing synthetic sound on the basis of the signal changed of characteristic by the voice characteristic processor 309. Reference numeral 311 is an amplifier for amplifying a power level of the synthetic sound synthesized by the voice synthesizer 310.

The operation of the third embodiment will be now explained. The microphone 301 picks up sound. The delay circuit 306 delays the sound picked up by the microphone 301. The filter 307 attenuates warning sound having frequency F1 from the sound delayed by the delay circuit 306.

The sound picked up by the microphone 301 is analyzed of frequency by the filter bank 302. Of the signal analyzed of frequency by the filter bank 302, the frequency component in the band around the frequency F1 is sent out to the power meter 303, in which a power level of the frequency F1 is measured. Of the signal analyzed of frequency by the filter bank 302, moreover, the signal component in the band around the frequency Fenv is sent out to the standard power meter 304, in which a power level of the frequency Fenv is measured. The arithmetic and control unit 305 determines a ratio (F1/Fenv), from the power level of the frequency F1 measured by the power meter 303 and the power level of the frequency Fenv measured by the standard power meter 304.

When the ratio determined by the arithmetic and control unit 305 is greater than a preset value (for example, 5.0), it is judged that the warning sound is included in the sound picked up by the microphone 301. In this case, the selector 308 selects a signal through the filter 307, and sends it to the voice characteristic processor 309.

When the ratio determined by the arithmetic and control unit 305 is smaller than the preset value, and the power level of the frequency Fenv measured by the power meter 304 is smaller than a specific value (for example, 100 dBspl), ambient sound except for the warning sound is not so loud, and it is judged that the warning sound is absence. In this case, the selector 308 selects the sound delayed by the delay circuit 306, and sends it to the voice characteristic processor 309.

When the power level of the frequency Fenv is greater than the specific value, regardless of the presence or the absence of the warning sound, it is judged that noise included in the ambient sound is high. In this case, the selector 308 selects neither the signal through the filter 307 nor the sound delayed by the delay circuit 306, and no signal is sent to the voice characteristic processor 309.

The voice characteristic processor 309 changes characteristic of frequency and time of the signal sent by the selector 308, depending on the hearing characteristic of the wearer. The voice synthesizer 310 receives the signal processed by the voice characteristic processor 309, and synthesizes synthetic sound. The amplifier 311 amplifies the power level of the synthetic sound synthesized by the voice synthesizer 310.

In this way, it is the effect of the hearing aid of the embodiment that the warning sound included in the input sound can be attenuated when the warning sound suddenly gets into the ambient sound included in the input sound, on the basis of the ratio determined by the arithmetic and control unit 305 and the power level of the frequency Fenv measured by the standard power meter 304, and that unpleasant sound due to excessively amplified the warning sound or the like is prevented from being applied to the wearer.

In the embodiment, meanwhile, the arithmetic and control unit 305 uses the power level in the specified frequency Fenv which is not included in the warning sound having the frequency F1 as a reference for the ratio, but not limited to this, it may use a power level based on plural specific frequency components which are not included in the warning sound having the frequency F1 as the reference, or it may uses a power level in a specific frequency band which includes all or part of the warning sound having the frequency F1 as the reference, or it may uses, same as in the first embodiment, a power level of the sound picked up by the microphone 301 without frequency analysis as the reference.

Also in the embodiment, the standard power meter 304 measures a power level without determining the voiceless period, but not limited to this, the standard power meter 304 may measure a power level after the voiceless period is determined.

Also in the embodiment, using the filter bank 302, the sound picked up by the microphone 301 is analyzed of frequency, but not limited to this, the sound may be analyzed of frequency by using a known method of frequency analysis technique such as FFT and filter analysis.

Also in the embodiment, the arithmetic and control unit 305 determines the ratio of the power level of the frequency F1 measured by the power meter 303 to the power level of the frequency Fenv measured by the standard power meter 304, but not limited to this, the arithmetic and control unit 305 may determine difference between the power level of the frequency F1 measured by the power meter 303 and the power level of the frequency Fenv measured by the standard power meter 304.

Figure 5:
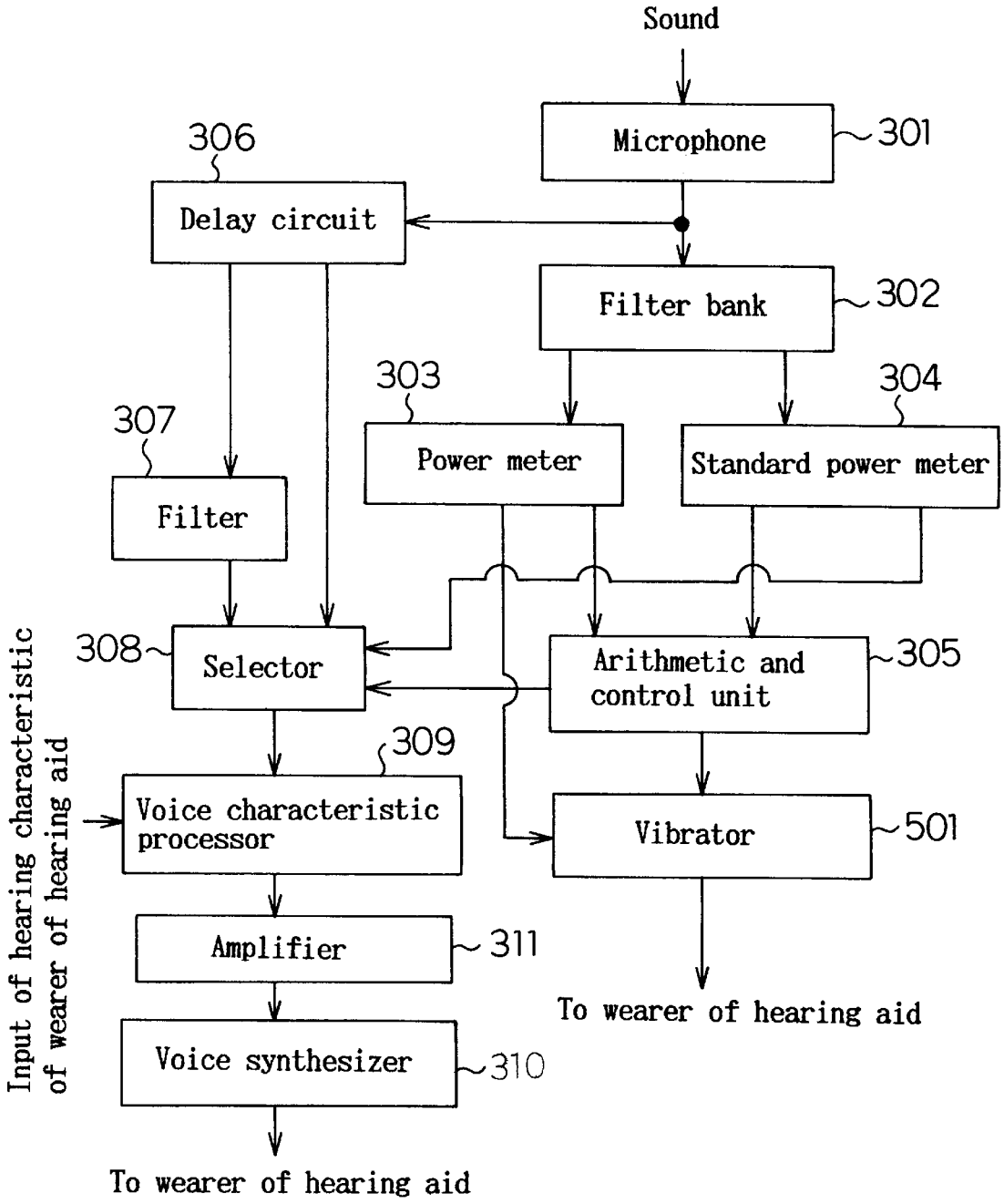
FIG. 5 is a structural diagram of a fourth embodiment of a hearing aid of the invention.

Referring to FIG. 5, there is shown therein a structural diagram of a fourth embodiment of a hearing aid of the invention. Warning sound in the embodiment is assumed to be sound at frequency F1 [Hz] or having a band width around that the frequency F1, as shown in FIG. 4(*b*). Reference numeral 301 is a microphone for picking up sound. Reference numeral 302 is a filter bank for analyzing frequency of the sound picked up by the microphone 301. Reference numeral 303 is a power meter for measuring power level of the frequency F1 analyzed by the filter bank 302. Reference numeral 304 is a standard power meter for detecting a voiceless period for a specific frequency Fenv [Hz] which is not contained in the warning sound having the frequency F1, same as in the first embodiment, and for measuring a power level of the frequency Fenv in the voiceless period. Reference numeral 305 is an arithmetic and control unit for determining ratio of the power level of the frequency F1 measured by the power meter 303 to the power level of the frequency Fenv in the voiceless period measured by the standard power meter 304.

Reference numeral 306 is a delay circuit for delaying the sound picked up by the microphone 301. This is to compensate for processing time by the filter bank 302, the power meter 303, the standard power meter 304, and the arithmetic and control unit 305. Reference numeral 307 is a filter corresponding to the frequency F1 for removing the warning sound. Reference numeral 308 is a selector for selecting whether to receive the sound delayed by the delay circuit 306 to send out into the voice characteristic processor 309 or to receive a signal through the filter 307 to send out to the voice characteristic processor 309 nor to receive either signal, on the basis of the ratio determined by the arithmetic and control unit 305 and the power level of the frequency Fenv in the voiceless period measured by the standard power meter 304.

Reference numeral 309 denotes voice characteristic processor for changing characteristic of frequency and time of the signal sent from the selector 308, depending on hearing characteristic of a wearer of the hearing aid. In the voice characteristic processor 309, the hearing characteristic of the wearer is stored in advance. Reference numeral 311 is an amplifier for amplifying a signal changed of characteristic by the voice characteristic processor 309. Reference numeral 310 is a voice synthesizer for synthesizing synthetic sound on the basis of the signal amplified by the amplifier 311. Reference numeral 501 is a vibrator for informing the wearer by vibration that the warning sound is emitted, on the basis of the power level of the frequency F1 measured by the power meter 303.

The operation of the fourth embodiment will be now explained. The microphone 301 picks up sound. The delay circuit 306 delays the sound picked up by the microphone 301. The filter 307 attenuates warning sound having the frequency F1 from the sound delayed by the delay circuit 306.

The sound picked up by the microphone 301 is analyzed of frequency by the filter bank 302. Of the signal analyzed of frequency by the filter bank 302, the frequency component in the band around the frequency of F1 is sent out to the power meter 303, in which a power level of the frequency F1 is measured. Of the signal analyzed of frequency by the filter bank 302, moreover, the signal component in the band around the frequency Fenv is sent out to the standard power meter 304, in which a power level of the frequency Fenv in the voiceless period is measured. The arithmetic and control unit 305 determines a ratio (F1/Fenv) from the power level of the frequency F1 measured by the power meter 303 and the power level of the frequency Fenv in the voiceless period measured by the standard power meter 304.

When the ratio is greater than a preset value (for example, 5.0), it is judged that the warning sound is included in the sound picked up by the microphone 301. In this case, the selector 308 selects a signal through the filter 307, and sends it to the voice characteristic processor 309.

When the ratio is smaller than the preset value, and the power level of the frequency Fenv in the voiceless period measured by the power meter 304 is smaller than a specific value (for example, 100 dBspl), ambient sound except for the warning sound is not so loud, and it is judged that the warning sound is not present. In this case, the selector 308 selects the sound delayed by the delay circuit 306, and sends it to the voice characteristic processor 309.

When the power level of the frequency Fenv in the voiceless period measured by the power meter 304 is greater than the specific value, regardless of the presence or the absence of the warning sound, it is judged that noise included in the ambient sound is high. In this case, the selector 308 selects neither the signal through the filter 307 nor the sound delayed by the delay circuit 306, and no signal is sent to the voice characteristic processor 309.

The voice characteristic processor 309 changes characteristic of frequency and time of the signal sent from selector 308, depending on hearing characteristic of the wearer. The amplifier 311 amplifies a power level of the signal changed of the characteristic by the voice characteristic processor 309. The voice synthesizer 310 receives the signal of which power level is amplified by the amplifier 311, and synthesizes synthetic sound.

It is sometimes desired that the warning sound be sensed, whether the sound is large or small, by the wearer in any method. In this embodiment, it is detected whether the warning sound is issued or not, on the basis of the power level of the frequency F1 measured by the power meter 303. That is, when the power level of the frequency F1 measured by the power meter 303 is larger than the specified value, it is judged that the warning sound is issued. In this case, by vibrating the vibrator 501, the issue of the warning sound can be noticed to the wearer.

In this way, it is the effect of the hearing aid of the embodiment that the warning sound included in the input sound can be attenuated when the warning sound suddenly gets into the ambient sound included in the input sound, on the basis of the ratio determined by the arithmetic and control unit 305 and the power level of the frequency Fenv in the voiceless period measured by the standard power meter 304, and that unpleasant sound due to excessively amplified the warning sound or the like is prevented from being applied to the wearer.

The hearing aid of the embodiment can tell the issue of warning sound to the wearer.

Incidentally, in this embodiment, the vibrator 501 is used for telling that the warning sound is issued to the wearer, but not limited to this, for example, visible light may be used.

In the embodiment, meanwhile, the arithmetic and control unit 305 uses the power level in the specified frequency Fenv which is not included in the warning sound having frequency F1 as a reference for the ratio, but not limited to this, it may use a power level based on plural specific frequency components which are not included in the warning sound having frequency F1 as the reference, or it may uses a power level in a specific frequency band which includes all or part of the warning sound having frequency F1 as the reference, or it may uses, same as in the first embodiment, a power level of the sound picked up by the microphone 301 without frequency analysis as the reference.

Also in the embodiment, before the standard power meter 304 measures a power level, a voiceless period is determined, and the power level in the period is measured, but not limited to this, the power level may be measured without determining the voiceless period.

Also in the embodiment, using the filter bank 302, the sound picked up by the microphone 301 is analyzed of frequency, but not limited to this, the sound may be analyzed of frequency by using frequency analysis technique such as FFT and filter analysis.

Also in the embodiment, the arithmetic and control unit 305 determines the ratio of the power level of the frequency F1 measured by the power meter 303 to the power level of the frequency Fenv in the voiceless period measured by the standard power meter 304, but not limited to this, the arithmetic and control unit 305 may determine the difference between the power level of the frequency F1 measured by the power meter 303 and the power level of the frequency Fenv in the voiceless period measured by the standard power meter 304.

Figure 6:
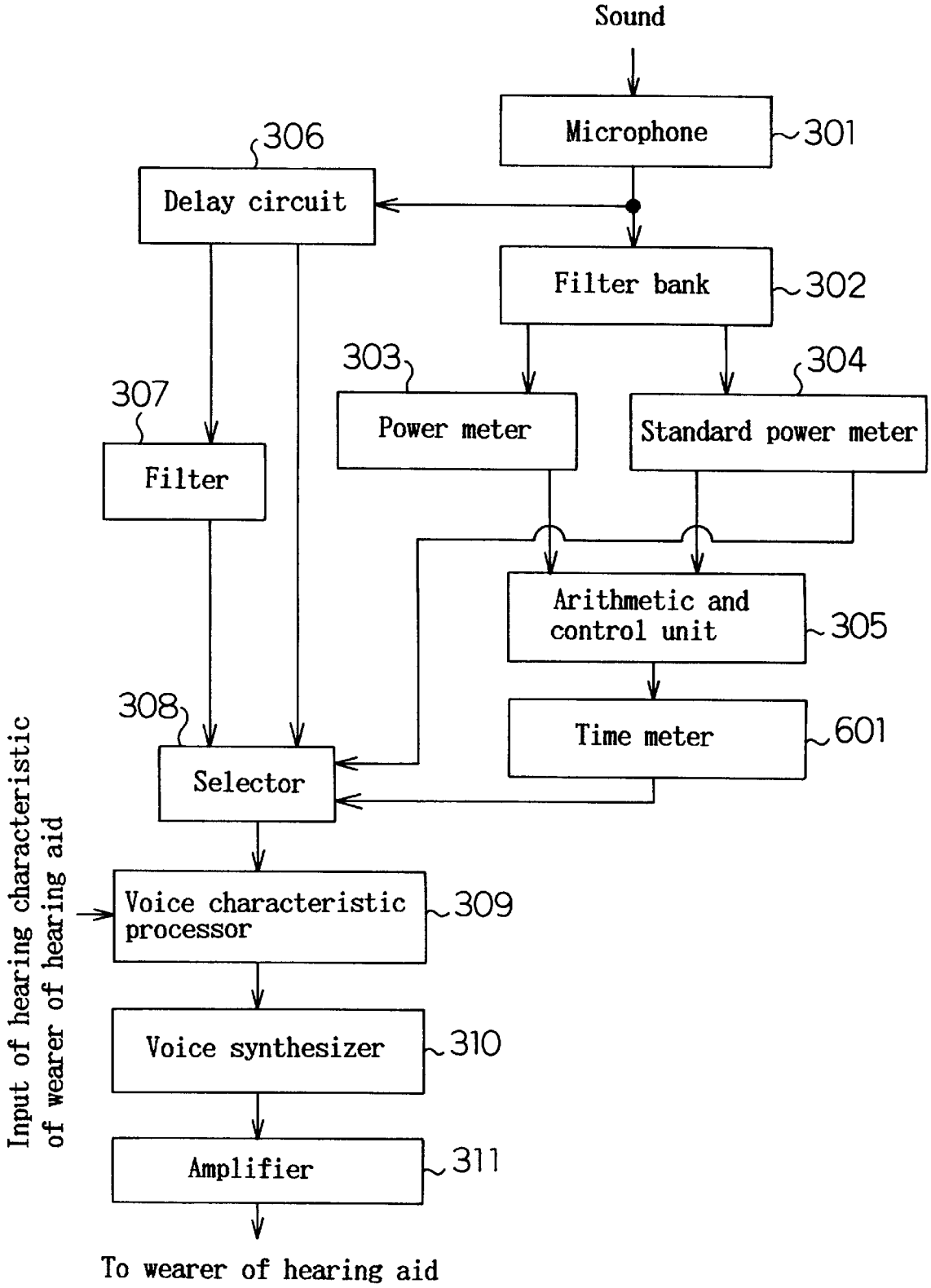
FIG. 6 is a structural diagram of a fifth embodiment of a hearing aid of the invention.

Referring to FIG. 6, there is shown therein a structural diagram of a fifth embodiment of a hearing aid of the invention. Warning sound in the embodiment is assumed to be sound at frequency F1 [Hz] or having a band width around the frequency F1, as shown in FIG. 4(*b*). Reference numeral 301 is a microphone for picking up sound. Reference numeral 302 is a filter bank for analyzing frequency of the sound picked up by the microphone 301. Reference numeral 303 is a power meter for measuring a power level of the frequency F1 analyzed by the filter bank 302. Reference numeral 304 is a standard power meter for detecting a voiceless period for a specific frequency Fenv [Hz] which is not contained in the warning sound having the frequency F1, same as in the first embodiment, and for measuring a power level of the frequency Fenv in the voiceless period. Reference numeral 305 is an arithmetic and control unit for determining difference of the power level of the frequency F1 measured by the power meter 303 minus the power level of the frequency Fenv in the voiceless period measured by the standard power meter 304. Reference numeral 601 is a time meter for determining length of the duration when the difference is greater than a specific value.

Reference numeral 306 is a delay circuit for delaying the sound picked up by the microphone 301. This is to compensate for processing time by the filter bank 302, the power meter 303, the standard power meter 304, and the arithmetic and control unit 305. Reference numeral 307 is a filter corresponding to the frequency F1 for removing the warning sound. Reference numeral 308 is a selector for selecting whether to receive the sound delayed by the delay circuit 306 to send out into the voice characteristic processor 309 or to receive a signal through the filter 307 to send out to the voice characteristic processor 309 nor to receive either signal, on the basis of the length of the duration determined by the time meter 601 and the power level of the frequency Fenv in the voiceless period measured by the standard power meter 304.

Reference numeral 309 denotes a voice characteristic processor for changing characteristic of frequency and time of the signal sent from the selector 308, depending on hearing characteristic of the wearer. In the voice characteristic processor 309, the hearing characteristic of the wearer is stored in advance. Reference numeral 310 is a voice synthesizer for synthesizing synthetic sound on the basis of the signal changed of characteristic by the voice characteristic processor 309. Reference numeral 311 is an amplifier for amplifying the synthetic sound synthesized by the voice synthesizer 310.

The operation of the fifth embodiment will be now explained. The microphone 301 picks up sound. The delay circuit 306 delays the sound picked up by the microphone 301. The filter 307 attenuates warning sound having the frequency F1 from the sound delayed by the delay circuit 306.

The sound picked up by the microphone 301 is analyzed of frequency by the filter bank 302. Of the signal analyzed of frequency by the filter bank 302, the frequency component in the band around the frequency of F1 is sent out to the power meter 303, in which a power level of the frequency F1 is measured. Of the signal analyzed of frequency by the filter bank 302, moreover, the signal component in the band around the frequency Fenv is sent out to the standard power meter 304, in which the power level of the frequency Fenv in the voiceless period is measured. The arithmetic and control unit 305 determines difference of the power level of the frequency F1 measured by the power meter 303 minus the power level of the frequency Fenv in the voiceless period measured by the standard power meter 304. The time meter 601 determines length of the duration when the difference determined by the arithmetic and control unit 305 is greater than a specific value.

When the length of the duration determined by the time meter 601 is longer than a preset value, it is judged that the warning sound is included in the sound picked up by the microphone 301. In this case, the selector 308 selects a signal through the filter 307, and sends it to the voice characteristic processor 309.

When the length of the duration determined by the time meter 601 is longer than the preset value, and the power level of the frequency Fenv in the voiceless period measured by the power meter 304 is smaller than a specific value, ambient sound except for the warning sound is not so loud, and it is judged that the warning sound is not present. In this case, the selector 308 selects the sound delayed by the delay circuit 306, and sends it to the voice characteristic processor 309.

When the power level of the frequency Fenv in the voiceless period measured by the power meter 304 is greater than the specific value, regardless of the presence or the absence of the warning sound, it is judged that noise included in the ambient sound is high. In this case, the selector 308 selects neither the signal through the filter 307 nor the sound delayed by the delay circuit 306, and no signal is sent to the voice characteristic processor 309.

The operation after the selector 308 is same as in the third embodiment shown in FIG. 3.

Thus, according to the hearing aid of the embodiment, by using two different features of frequency structure of the warning sound and its duration, the warning sound can be detected more securely.

Incidentally, in the embodiment, the arithmetic and control unit 305 determines the difference between the power level of the frequency F1 measured by the power meter 303 and the power level of the frequency Fenv in the voiceless period measured by the standard power meter 304, but not limited to this, the arithmetic and control unit 305 may also determine ratio from the power level of the frequency F1 measured by the power meter 303 and the power level of frequency Fenv in the voiceless period measured by the standard power meter 304.

In the embodiment, meanwhile, the time meter 601 uses the power level in the specified frequency Fenv which is not included in the warning sound having the frequency F1 as a reference for the difference, but not limited to this, it may use a power level based on plural specific frequency components which are not included in the warning sound having the frequency F1 as the reference, or it may uses a power level in a specific frequency band which includes all or part of the warning sound having the frequency F1 as the reference, or it may uses, same as in the first embodiment, a power level of the sound picked up by the microphone 301 without frequency analysis as the reference.

Also in the embodiment, the standard power meter 304 measures the power level in the voiceless period, but not limited to this, it may measure a power level without determining the voiceless period.

Also in the embodiment, the sound picked up by the microphone 301 is analyzed of frequency by using the filter bank 302, but not limited to this, the sound may be analyzed of frequency by using frequency analysis technique such as FFT and filter analysis.

Also in the embodiment, when the length of the duration determined by the time meter 601 is longer than the preset value, it is judged that the warning sound is included in the sound picked up by the microphone 301, but not limited to this, when the length of the duration determined by the time meter 601 is within a preset range, it may be judged that the warning sound is included in the sound picked up by the microphone 301.

Figure 7:
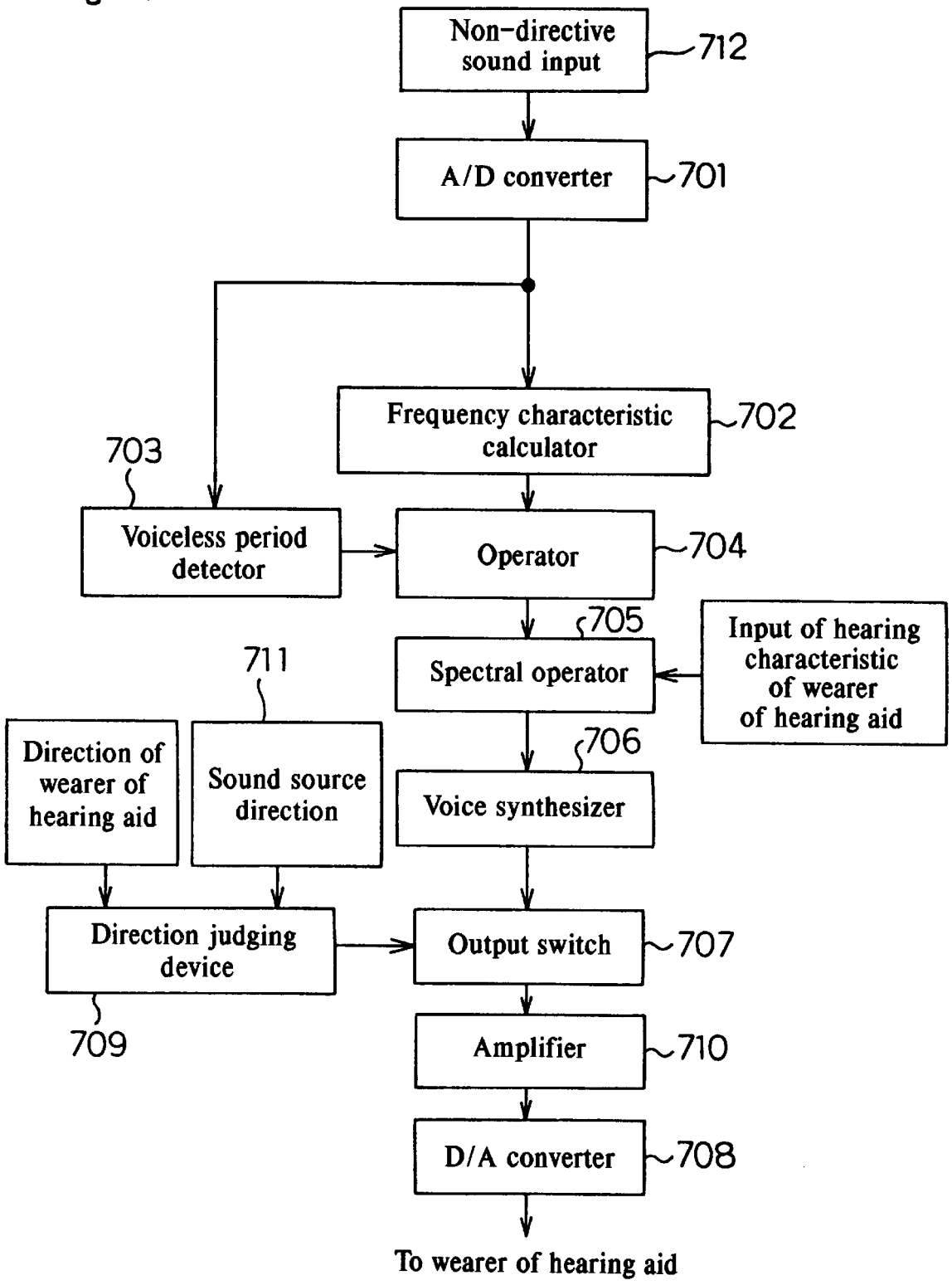
FIG. 7 is a structural diagram of a sixth embodiment of a hearing aid of the invention.

Referring to FIG. 7, there is shown therein a structural diagram of a sixth embodiment of a hearing aid of the invention. Reference numeral 701 is an A/D converter for converting input sound from analog into digital signal. Reference numeral 702 is a frequency characteristic calculator for determining spectral structure of the input sound converted by the A/D converter 701. Reference numeral 703 is a voiceless period detector for detecting a voiceless period from the A/D converted input sound. Reference numeral 704 is an operator for removing noise of ambient sound included in the spectral structure on the base of output of the frequency characteristic calculator 702 and the voiceless period detector 703. Reference numeral 705 is a spectral operator for changing characteristic of frequency and time of output of the operator 704 depending on hearing characteristic of a wearer of the hearing aid of the embodiment. In the spectral operator 705, the hearing characteristic of the wearer is stored in advance. Reference numeral 706 is a voice synthesizer for synthesizing synthetic sound on the basis of a signal changed of characteristic by the spectral operator 705.

Reference numeral 709 is a direction judging device for judging if a front side of the wearer is directed to an incoming direction of voice or not.

Reference numeral 707 is an output switch for changing over whether or not to send the synthetic sound synthesized by the voice synthesizer 706 to an amplifier 710 on the basis of the judgement by the direction judging device 709. Reference numeral 710 is an amplifier for amplifying the synthetic sound sent from the output switch 707. Reference numeral 708 is a D/A converter for converting the synthetic sound amplified by the amplifier 710 from digital into analog signal in order to produce output sound to the wearer.

The operation of the sixth embodiment will be now explained. The A/D converter 701 converts input sound from analog into digital signal, and sends it to the frequency characteristic calculator 702 and the voiceless period detector 703. The frequency characteristic calculator 702 analyzes the sound converted by the A/D converter 701 by filter analysis to determine the sound is composed of what frequency components. The voiceless period detector 703 detects a voiceless period from the input sound converted by the A/D converter 701, by using the known art of the short-time average zero-crossing rate, same as in the first embodiment. The operator 704 removes noise included in the input sound, by estimating frequency spectrum of noise included in the sound converted by the A/D converter 701, by using the spectrum subtraction technique on the basis of signals sent from the frequency characteristic calculator 702 and the voiceless period detector 703. The spectral operator 705 changes characteristic of frequency and time for the signal of which noise is suppressed by the operator 704, depending on the hearing characteristic of the wearer. The voice synthesizer 706 receives the signal changed of characteristic by the spectral operator 705, and synthesizes synthetic sound by the known synthesizing method of DFT (discrete Fourier transform) or LPC (linear predictive coding).

Parallel to the above process, the direction judging device 709 judges if a front side of the wearer is directed to an incoming direction of voice or not. The hearing aid of the embodiment comprises a directive microphone 711, aside from a non-directional microphone 712 used in an ordinary hearing aid. When wearing the hearing aid, the directive microphone is mounted so as to pick up sound in front of the wearer. The direction judging device 709 judges whether a front side of the wearer is directed to an incoming direction of voice or not, on the basis of sound picked up by the non-directional microphone and sound picked up by the directive microphone. That is, when a power level of the sound picked up by the directional microphone nearly equals a power peak of the sound picked up by the non-directional microphone, it is judged that the front side of the wearer is directed to the incoming direction of voice. Not limited to this method, however, it is also realized by a method of determining the direction where a power level of sound reaches the maximum or a method of using a stereo microphone.

The output switch 707 changes over whether or not to send the synthetic sound synthesized by the voice synthesizer 706 to the amplifier 710, on the basis of the judgement by the direction judging device 709. The amplifier 710 amplifies the synthetic sound sent from the output switch 707. The D/A converter 708 converts the synthetic sound sent from the output switch 707 from digital into analog signal, in order to emit output sound to the wearer.

Thus, according to the embodiment, the output sound can be controlled by detecting the specific information presented by the wearer.

Also in the embodiment, the output sound is controlled depending on whether the front side of the wearer is directed to the incoming direction of the voice or not, but not limited to this, the output sound may be controlled depending on the line of vision of the wearer, or opening or closing of the eyes of the wearer.

As clear from the description of these embodiments, according to the hearing aid of the invention, the output of the hearing aid can be controlled depending on noise included in ambient sound.

In the invention, by detecting the warning sound suddenly appearing in ambient sound, it can be attenuated, so that the hearing aid not amplifying such sound can be presented.

The invention also has the effect of controlling output of the hearing aid on the basis of specific information presented by the wearer.

Incidentally, the voiceless period in the invention is not limited to a period completely free from voice, but may be a period containing voice which is not removed by a threshold value as in the first embodiment.

Also in the above-mentioned embodiments, a block of a means (for example, earphone) for emitting sound to a wearer of the hearing aid is not shown in FIGS. 1, 2, 3, 5, 6 and 7. The means is included in a sound output means of the invention.

Furthermore in the above-mentioned embodiments, a block of a means (for example, microphone) for receiving sound is not shown in FIGS. 1, 2 and 7. The means is included in a sound input means of the invention.

What is claimed is:

1. A hearing aid for a wearer receiving sounds comprising:

at least two sound input means for receiving said sounds for producing first signals, information detecting means for detecting, based on the first signals, whether a front of the wearer is directed to an incoming direction of the sound and producing second signals, an analyzer to analyze said sounds and determine frequency components of said sounds, a detector to detect a voiceless period of said sounds, a subtractor to remove noise from said sounds, said subtractor using a spectrum subtraction technique and producing an intermediate sound, a spectral converter to change a frequency characteristic of the intermediate sound based on a hearing characteristic of the wearer and the frequency components of said sounds and producing a further intermediate signal, a synthesizer to synthesize the further intermediate signal using at least one of a discrete fourier transform and a linear predictive coding to produce a synthetic sound, amplifying means for amplifying the first signals, sound output means for emitting the sound amplified by said amplifying means, and control means for automatically changing an amplification factor of said amplifying means as a function of the second signals.

2. A method for aiding the hearing of a wearer receiving sounds comprising the steps of:

(a) receiving said sounds from at least two sound inputs, (b) producing first signals based on the sounds received in Step (a), (c) analyzing the sounds received in Step (a) and determining frequency components of the sounds, (d) detecting a voiceless period of the sounds received in Step (a), (e) removing noise from the sounds received in Step (a) by using a spectrum subtraction technique and producing an intermediate sound, (f) changing a frequency characteristic of the intermediate sound based on a hearing characteristic of the wearer and the frequency components of the sounds of step (b1) and producing a further intermediate signal, (g) synthesizing the further intermediate signal using at least one of a discrete fourier transform and a linear predictive coding to produce a synthetic sound, (h) detecting whether a front of the wearer is directed to an incoming direction of the sound and producing second signals, based on the first signals, (i) amplifying the first signals, (j) emitting the sound amplified by said amplifying means, and (k) automatically changing an amplification factor of said amplifying means as a function of the second signals.

* * * * *